United States Patent [19]

Côté

[11] 4,423,988

[45] Jan. 3, 1984

[54] MANURE HANDLING UNIT

[76] Inventor: Camille Côté, 5, Premiere Ave., P.O. Box 8, Warwick, Quebec, Canada, J0A 1M0

[21] Appl. No.: 266,637

[22] Filed: May 26, 1981

[51] Int. Cl.[3] ..... B65G 53/40

[52] U.S. Cl. ..... 406/125; 49/214; 220/345; 222/510; 406/130

[58] Field of Search ..... 406/124, 125, 126, 130, 406/132, 146; 220/262, 329, 345; 222/505, 510, 512, 560, 561; 49/213, 214

[56] References Cited

U.S. PATENT DOCUMENTS

| | | | |
|---|---|---|---|
| 2,688,423 | 9/1954 | Davis | 406/132 |
| 2,723,057 | 11/1955 | Golden | 406/146 X |
| 3,103,276 | 9/1963 | Schmitzer . | |
| 3,237,993 | 3/1966 | Gurney . | |
| 3,637,311 | 8/1972 | Nesseth . | |
| 3,872,981 | 3/1975 | Hedlund . | |
| 3,953,078 | 4/1976 | Aitken . | |
| 3,995,853 | 5/1976 | Rusterholz . | |
| 4,098,541 | 4/1978 | Cote . | |
| 4,186,523 | 2/1980 | Palmaer | 49/214 X |

FOREIGN PATENT DOCUMENTS

| | | | |
|---|---|---|---|
| 659662 | 3/1963 | Canada . | |
| 857189 | 12/1970 | Canada . | |
| 1059056 | 7/1979 | Canada . | |
| 605429 | 11/1934 | Fed. Rep. of Germany | 406/125 |
| 578421 | 9/1924 | France . | |
| 268667 | 4/1927 | United Kingdom . | |

*Primary Examiner*—Jeffrey V. Nase

*Attorney, Agent, or Firm*—Bacon & Thomas

[57] ABSTRACT

A manure handling unit comprising a manure holding tank having an inlet and an outlet and a conduit section leading from the outlet. An inlet valve is provided within the tank for closing the inlet. An operating device within the tank operates the inlet valve. The unit also has an outlet valve within a sleeve extending between the conduit and the tank. An operating device in the tank operates the outlet valve in the sleeve to close or open the conduit.

5 Claims, 6 Drawing Figures

FIG. 4
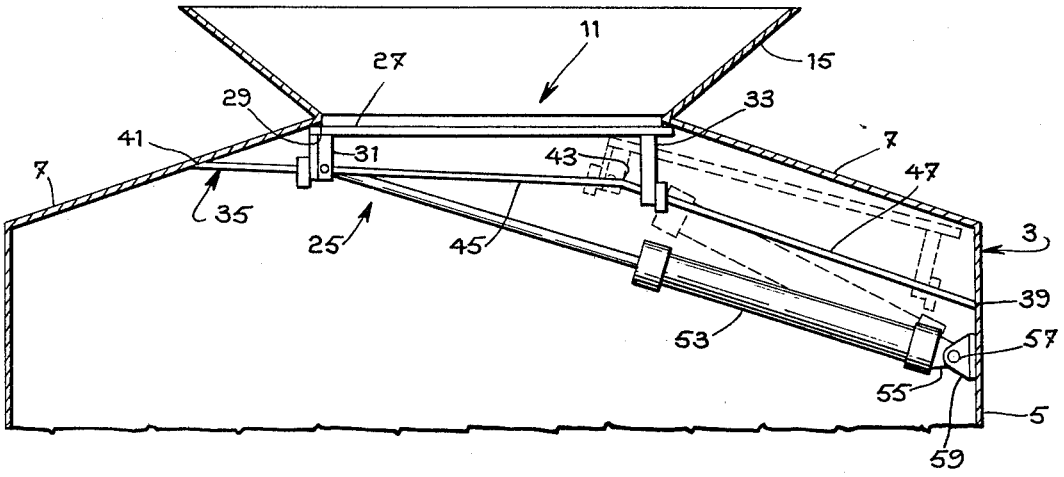
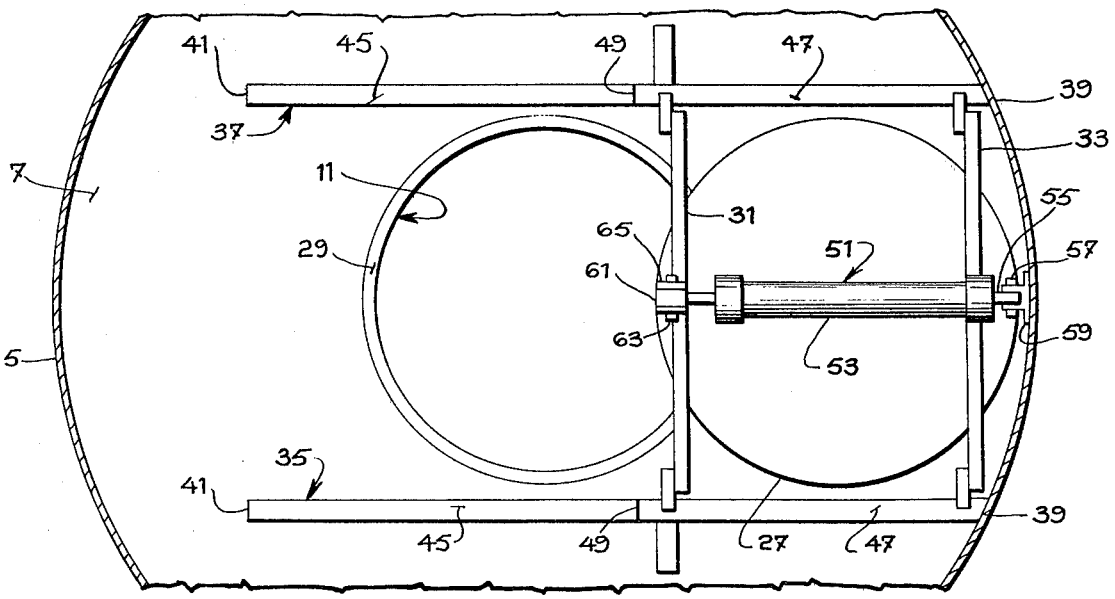
FIG. 5

MANURE HANDLING UNIT

The present invention relates to an improved manure handling unit.

It is known to provide an apparatus for handling manure which apparatus includes a tank for collecting manure. The tank is placed in the ground within a barn and has a top inlet for receiving manure. Valve means selectively close the inlet. The bottom of the tank has an outlet which connects to a conduit for carrying manure from the tank to the bottom of a manure pile outside the barn. Valve means are provided for selectively closing the conduit. When it is desired to empty the tank of manure, the inlet valve is closed, the outlet valve is opened, and compressed air is introduced into the top of the tank to push the manure out. Such an apparatus is shown in Canadian Pat. No. 1,059,056.

The above apparatus works satisfactorily. However it has been discovered that the apparatus has some drawbacks. For example, the apparatus comprises several separate components, such as the tank, the conduit means, and the valve means in the conduit means. The handling and installation of these separate components is inefficient and time consuming. Another disadvantage is that the outlet valve means, and more particularly, its operating means, is open and exposed during handling and installation and thus liable to damage. A further disadvantage, due to the separation of the tank and the outlet valve means is that separate power and/or control lines are needed to operate both the inlet and outlet valve means. Yet another disadvantage is that the inlet valve means within the tank requires considerable space thereby reducing useable storage space within the tank. In addition, the inlet valve means is somewhat complicated in structure.

It is therefore an object of the present invention to provide an improved manure handling unit which is more compact and thus easier to handle and install than known units.

It is another object of the present invention to provide an improved manure handling unit in which the movable and/or operating parts of the unit are protected thereby making it safer to handle and install the unit.

It is a further object of the present invention to provide a manure handling unit in which the tank inlet valve means is simplified and made more compact.

In accordance with the present invention these objects are achieved with an improved manure handling unit which combines previously separate components. More particularly, the improved manure handling unit according to the invention combines the tank, a conduit section, inlet and outlet valve means, and inlet and outlet valve operating means into a single piece of equipment thereby improving handling and installation of the equipment.

In accordance with the present invention, it is preferred to have the movable components of the unit such as the valve means, and the valve operating means, enclosed within the unit, or more specifically, within parts of the unit so as to protect them from damage.

In accordance with the present invention, it is also preferred to have the valve inlet means composed of a valve closure plate fixed to a pair of cross-supports which supports are in turn slidably mounted on a pair of bent, sloping guide rails. The operating means is connected to the leading support to move the plate along the rails between open and closed positions. The arrangement provides for a compact and simple closure.

The invention is particularly directed toward a manure handling unit having a tank for holding manure, the tank having a top inlet and a bottom outlet. A conduit section is connected to the tank and leads away from the outlet. The unit has inlet valve means for opening or closing the inlet, and outlet valve means for opening or closing the conduit section. The tank carrier inlet and outlet operating means for operating the inlet and outlet valve means respectively. The outlet valve means are mounted within the unit and the outlet valve operating means are mounted within the tank.

A preferred embodiment of the invention will now be described in detail having reference to the accompanying drawings in which:

FIG. 4 is a detail elevation view, in partial section, of the inlet end of the tank;

FIG. 5 is a detail bottom view of the inlet end of the tank; and

Figure 1:
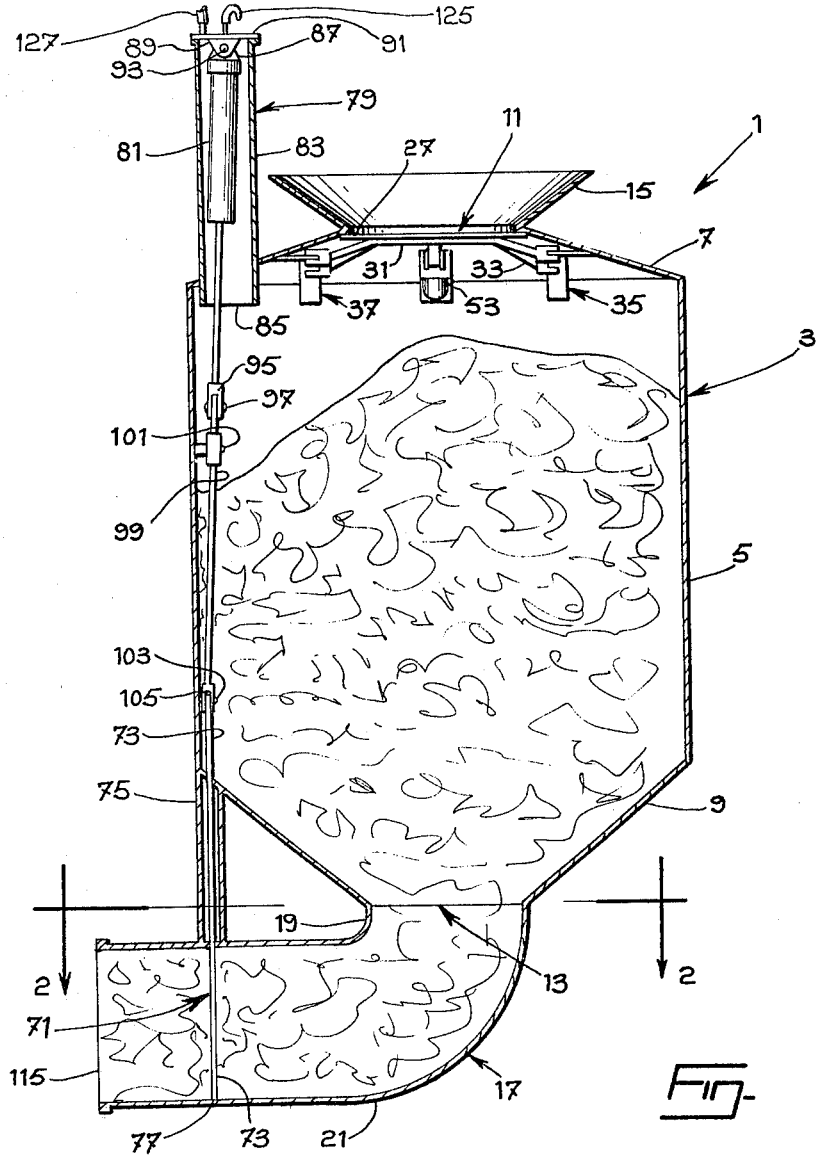
FIG. 1 is a cross-sectional view of the manure handling unit.
Figure 3:
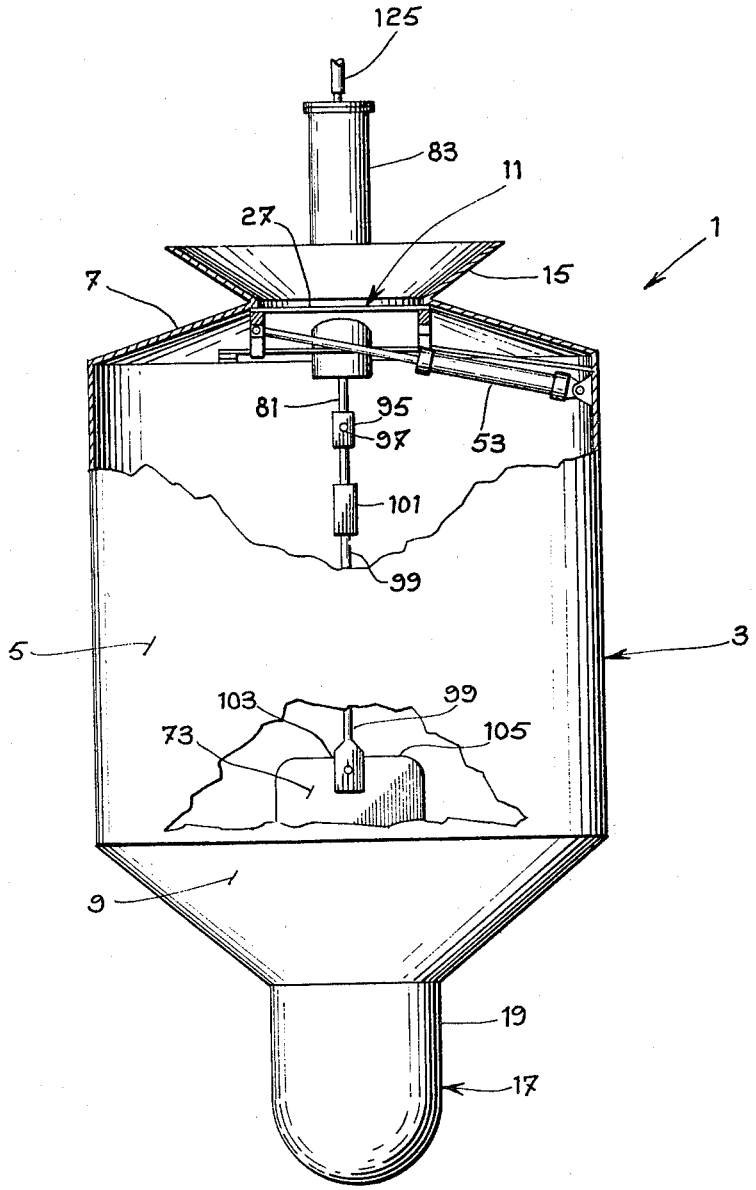
FIG. 3 is an elevation view of the unit, in partial section.

The manure handling unit 1 as shown in FIGS. 1 and 3, includes a holding tank 3 for receiving manure. The tank 3 has a cylindrical sidewall 5, a truncated conical top wall 7 and a truncated conical bottom wall 9. A central inlet 11, preferably circular in shape, is provided in the top wall 7, and a central outlet 13, also preferably circular in shape, is provided in the bottom wall 9. A truncated, conical mouth 15 can be fixed to the top wall 7 of the tank 3 for directing manure into the tank.

The unit 1 also includes an elbow 17, preferably a right-angle elbow, fixed to the bottom wall 9 of the tank 3 for directing manure out of the tank, through outlet 13. The elbow 17 has a relatively short vertical arm 19 fixed to the tank 3, and a relatively long horizontal arm 21 which projects past the side wall 5 of the tank 3.

Inlet valve means 25, as shown in detail in FIGS. 4 and 5, is provided within the tank 3 for selectively closing the inlet 11. Valve means 25 comprises a circular closure plate 27 slightly larger in diameter than inlet 11. The plate is slidably mounted for movement between a closed position, where the plate 27 is pressed tight against the edge 29 of the top wall 7 surrounding inlet 11, and a open position where the plate 27 is moved to the side of the inlet 11 and slightly down from the inlet. The plate 27 is fixedly mounted on two spaced-apart supports 31, 33. The supports 31, 33 in turn are slidably mounted at their ends on two spaced-apart guide members 35, 37. The guide members 35, 37 are located on either side of inlet 11 and, at one end 39, are fixed to the side wall 5 just below top wall 7. At their other end 41, the guide members 35, 37 are fixed to the top wall 7, about midway between the inlet 11 and side wall 5. The use of the outwardly and downwardly sloping top wall 7 on the tank permits the guide members to be easily yet securely fastened at their ends in position close to the inlet.

The guide members 35, 37 are slightly bent, as shown at 43 about midway between their ends 39, 41. The straight upper section 45 of the guide members 35, 37, between end 41 and bend 43 slopes down slightly from end 41. The straight lower section 47 of the guide members 35, 37, between bend 43 and end 39, slopes down from bend 43 to end 39 at a slightly greater angle than the angle at which the upper section 45 slopes. The sloping lower section 47 is generally parallel to the sloping top wall 7. The guide members 35, 37 are located relatively close to the inlet opening 11 and the top wall 7. Because the upper section 45 of the guide members 35, 37 slopes down slightly, relative to the plane of inlet 11, the rear or trailing support 33 is slightly higher than the front or leading support 31 so as to have the closure plate 27 sit flush on the horizontal edge 29 adjacent inlet 11 when closing the inlet.

The closure plate 27 is moved along the sloping guide members 35, 37, via the support 31, 33, by suitable inlet operating means 51. The inlet operating means 51 comprises a pneumatic actuator 53, pivotally connected at one end 55, by a pivot pin 57, to a bracket 59 fixed to the side wall 5 just below, and centrally between, the ends 39 of the guide members 35, 37. The other end 61 of the actuator 53 is pivotally connected, by a pivot pin 63, to a bracket 65 on the bottom of leading support 31 midway between its ends.

Operation of the pneumatic actuator 53 will move the closure plate 27 between its inoperative position to the side of the inlet 11, as shown by dotted lines in FIG. 4, and its operative position, jammed tight against edge 20 to close inlet 11. The angled guide rods 35, 37 permit the plate 27 to be moved mainly in an arc-like motion thereby minimizing binding. The bent guide rods 35, 37, in allowing free movement of the plate 27, also permit the actuator 53 to be attached to the front support member 31 thereby providing a simple structure. The use of the sloping, bent, guide members 35, 37 provides a very compact inlet valve means 25 located closely adjacent the top wall of the holding tank and thereby maximizing the capacity of the tank.

Figure 2:
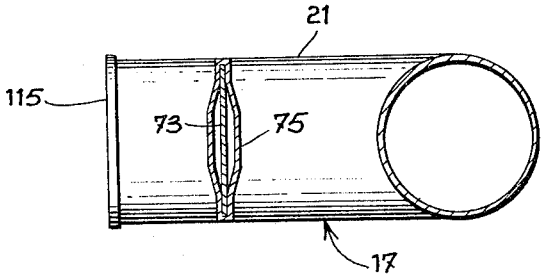
FIG. 2 is a cross-section view taken along line 2—2 of FIG. 1.

Outlet valve means 71 are provided in the elbow 17 for selectively closing the tank 3 as shown in FIGS. 1 and 2. The outlet valve means 71 has a closure plate 73 mounted for sliding movement in a narrow, rectangular sleeve 75. The sleeve 75 extends between the elbow 17, and the bottom wall 9 of the tank 3. More particularly, the sleeve 75 extends transversely up from the long horizontal arm 21 of the elbow 17 to intersect the bottom wall 9 of the tank adjacent its side wall 5. The closure plate 73 is movable through the sleeve 75 between a closed position, where the semi-circular bottom edge 77 of plate 73 rests on the bottom of the elbow 17 thereby closing the outlet end of tank, and an open position where the plate's bottom edge 77 is within sleeve 75. When moved to its open position, the top portion of the closure plate 73 slides up in the tank adjacent the side wall 5.

Outlet operating means 79 are provided for moving the outlet valve means 71 between its open and closed positions. These moving means 79 comprise a second pneumatic actuator 81 which is mounted within a housing 83 projecting up from the top wall 7 of the tank 3. The housing 83 is located adjacent the side wall 5 of the tank 3 and is generally aligned with the sleeve 75. The housing 83 projects slightly into the tank 3, and its bottom end 85 is open. The actuator 81 is pivotally mounted at its top end 87 to a bracket 89 fixed to the top end wall 91 of housing 83 by a pivot pin 93. The actuator 81 has its bottom end 95 pivotally mounted by a pin 97 to the top end of a connecting rod 99. The connecting rod 99 is mounted for sliding movement adjacent the side wall 5 of the tank 3 by guide means 101 fixed to the side wall 5. The bottom end of the connecting rod 99 is attached by a pivot pin 103 to the top edge 105 of the closure plate 73. Operation of second actuator 81 will raise or lower closure plate 73 via connecting rod 99. The projecting housing 83 permits the actuator to be mounted within the tank well above the manure within the tank.

The unit described above is compact and self-contained. The top inlet 11 of the tank is opened or closed by means which take up little room within the tank. The inlet valve means also are protected within the tank during shipping, installation and use of the unit. Similarly, the outlet end of the tank is also opened or closed by means which take up little room within the unit. These second valve means are also protected within the unit during its shipping, installation and use.

Figure 6:
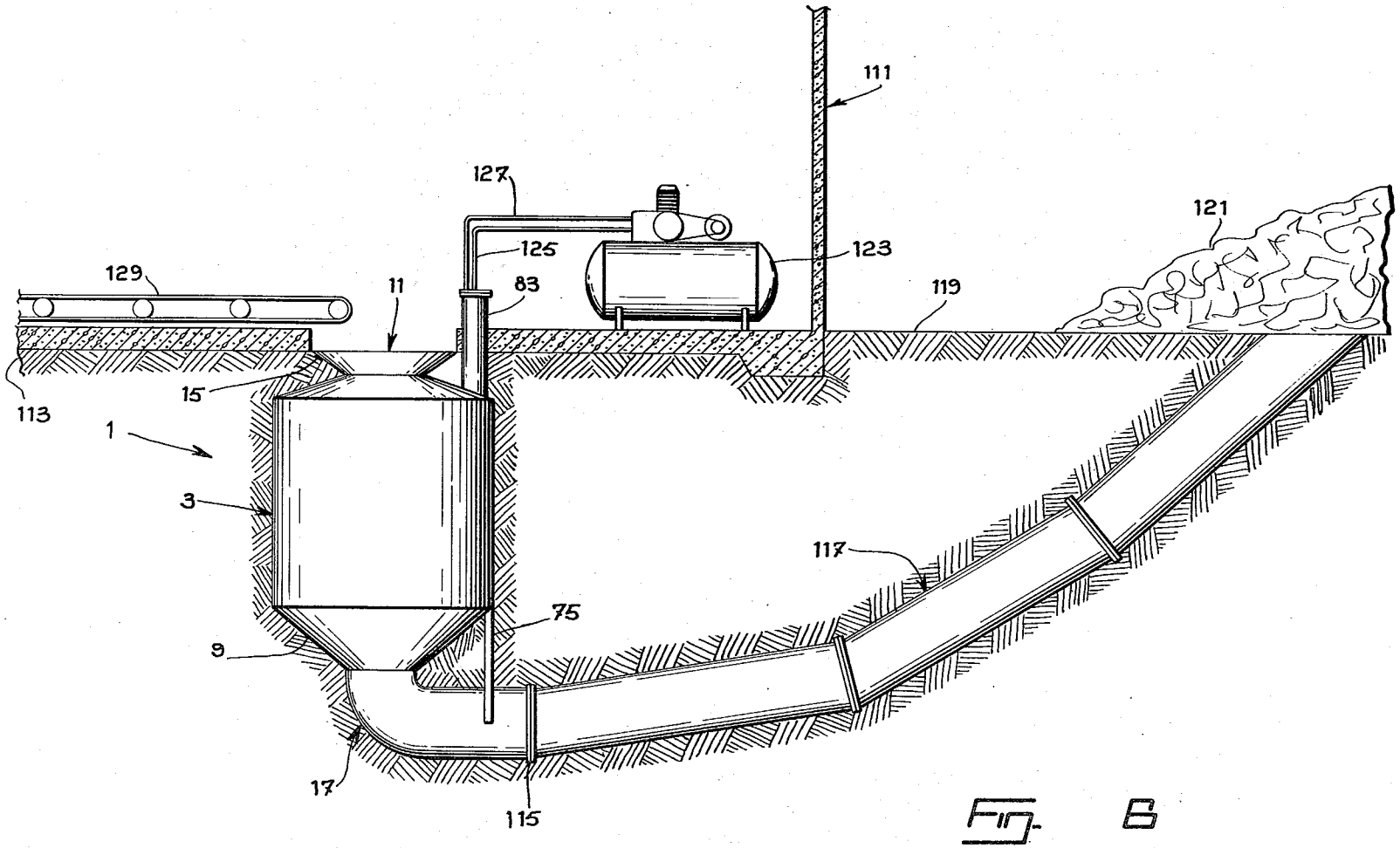
FIG. 6 is a schematic elevation view showing installation of the unit.

The unit 1 its installed within a barn 111 as shown in FIG. 6. More particularly, the unit 1 is installed in ground within the barn below the floor 113 or the barn. The mouth 15 of the tank 3 can be flush with, or just below, the floor 113. The housing 83 for the actuator 81 extends above the floor 113. The free end 115 of the elbow 17 is connected to a conduit 117 buried in the ground which leads out from under the barn 111 to ground surface 119 beneath a manure pile 121. An air compressor unit 123 is provided within the barn and is connected to the unit 1. A first line 125 carries compressed air to the housing 83. The line 125 is connected within the tank to the first and second actuators 53, 81 by suitable lines (not shown). A second line 127 carries compressed air to the interior of the tank 3 via housing 83. Suitable valves and controls can be provided to control the operation of the compressor unit 123 and the flow of compressed air to the actuators 53, 81 and to the tank. The raised housing 83 permits the compressed air lines to be easily connected to the unit within the barn after installation of the unit.

In operation, manure is conveyed to the tank 1 by suitable means such as a conveyor 129 mounted on the floor 113 of the barn. The manure falls into the tank 3 via mouth 15 and inlet 11 while the closure plate 27 is in an open position as a result of operation of actuator 53. During filling of the tank 3 with manure, the outlet closure plate 73 is in its closed position, retaining the manure within the tank and elbow 17. When the tank is substantially full, inlet closure plate 27 is closed by actuator 53, outlet closure plate 73 is opened by second actuator 81, and compressed air is fed into the top of the tank 3 through line 127, and housing 83 to move the manure out of the tank, through outlet 13 and through the elbow 17 and conduit 117 to the bottom of the manure pile 121. After the tank is emptied, line 127 is closed, the outlet closure plate 53 is closed and inlet closure plate 27 is opened so that the tank can receive more manure.

The embodiments of the invention in which an exclusive property or provilege is claimed are defined as follows:

1. In a compact, self-contained manure handling unit of the type including a tank for holding manure, said tank having a top wall provided with a manure inlet and a bottom wall provided with a manure outlet, a conduit section connected to the tank and leading from the outlet, said conduit section including an elbow extending downwardly from the manure outlet of the tank and laterally outwardly therefrom, inlet valve means mounted within the tank for opening or closing the manure inlet, inlet operating means mounted within the tank for operating the inlet valve means, outlet valve means for opening or closing the conduit section, outlet operating means for operating the outlet valve means, and means for introducing compressed air into the tank to push manure out through the conduit when the inlet is closed and the outlet is opened, the improvement comprising:

(a) the outlet valve means includes an outlet closure plate slidably mounted in a narrow sleeve extending transversely between the bottom wall of the tank and the elbow, said closure plate being movable through the sleeve between a closed position where it extends across the elbow, and an open position where it is located within the sleeve; and (b) the outlet operating means includes an actuator located in a housing projecting upwardly from the top wall of the tank in a generally aligned position with respect to the sleeve, and means within the tank for operatively connecting the actuator to the outlet closure plate.

2. The unit of claim 1 wherein the inlet valve means comprises an inlet closure plate, and the inlet operating means comprises a pair of spaced apart support members carrying the plate, a pair of space-apart, downwardly sloping guide members extending across the inlet within the tank close to the top wall of the tank, the support members being slidably mounted on the guide members, and an actuator connected at one end to the tank and at the other end to one of the support members.

3. The unit of claim 2 wherein the top wall of the tank is of a truncated conical shape, the top wall sloping down from the inlet toward the external periphery of the tank, the guide members extending across from the external periphery past the inlet to the top wall.

4. The unit of claim 3 wherein the guide members are configured to define a first sloping section in the inlet area and a second sloping section adjacent the inlet area, said second section sloping to a greater degree than said first section.

5. The unit of claim 1 further including means in the top of the housing for bringing compressed air to the actuator of the outlet operating means.

* * * * *